United States Patent [19]

Ito et al.

[11] Patent Number: 4,622,026

[45] Date of Patent: Nov. 11, 1986

[54] MANDREL FOR USE IN MANUFACTURING AN ANGLED AND CYLINDRICAL CONTAINER

[75] Inventors: Sukenori Ito, Fuchu; Yoshiaki Take, Tama; Takahisa Hirayama, Kiryu, all of Japan

[73] Assignee: Toppan Printing Co., Ltd., Japan

[21] Appl. No.: 803,052

[22] Filed: Nov. 29, 1985

Related U.S. Application Data

[62] Division of Ser. No. 627,435, Jul. 3, 1984, Pat. No. 4,581,003.

[30] Foreign Application Priority Data

| | | | |
|---|---|---|---|
| Jul. 8, 1983 | [JP] | Japan | 58-124446 |
| Jul. 8, 1983 | [JP] | Japan | 58-124447 |
| Jul. 8, 1983 | [JP] | Japan | 58-124448 |
| Jul. 8, 1983 | [JP] | Japan | 58-124450 |

[51] Int. Cl.[4] ..... B31B 1/90

[52] U.S. Cl. ..... 493/104; 493/111; 493/153; 493/175

[58] Field of Search ..... 493/101, 104, 108, 111, 493/152, 153, 450, 454, 455, 456, 467, 470, 471, 473, 476, 901, 451, 457, 175

[56] References Cited

U.S. PATENT DOCUMENTS

| | | | |
|---|---|---|---|
| 1,262,289 | 4/1918 | Weber | 220/468 |
| 2,037,777 | 4/1936 | Gazette | 493/152 |
| 2,063,013 | 12/1936 | Cooper | 493/152 |
| 4,106,397 | 8/1978 | Amberg et al. | 493/105 |

FOREIGN PATENT DOCUMENTS

| | | | |
|---|---|---|---|
| 3015112 | 10/1981 | Fed. Rep. of Germany | 493/152 |

*Primary Examiner*—Francis S. Husar
*Assistant Examiner*—Robert Showalter
*Attorney, Agent, or Firm*—Lerner, David, Littenberg Krumholz & Mentlik

[57] ABSTRACT

The present invention relates to a mandrel for use in manufacturing a container in which the mandrel includes a mandrel body in the shape of a cylinder, recessed portions located about the circumference of the mandrel body forming it into a polygon with inwardly depressed sides forming curved surfaces thereabout, and connecting portions separating the recessed portions and located substantially at the cylindrical outer surface of the mandrel, as well as a central channel in the mandrel and apertures located within the recessed portions and connecting them with the central channel so that a vacuum can be applied through the apertures to conform a container body placed on the outer surface of the mandrel to the shape of the mandrel.

3 Claims, 12 Drawing Figures

FIG.10
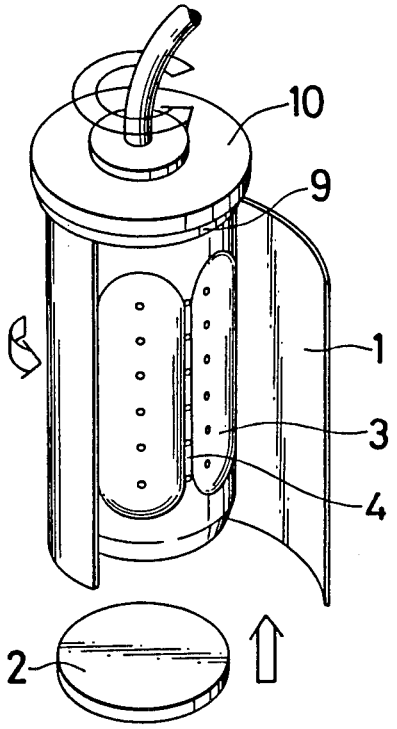
FIG.11
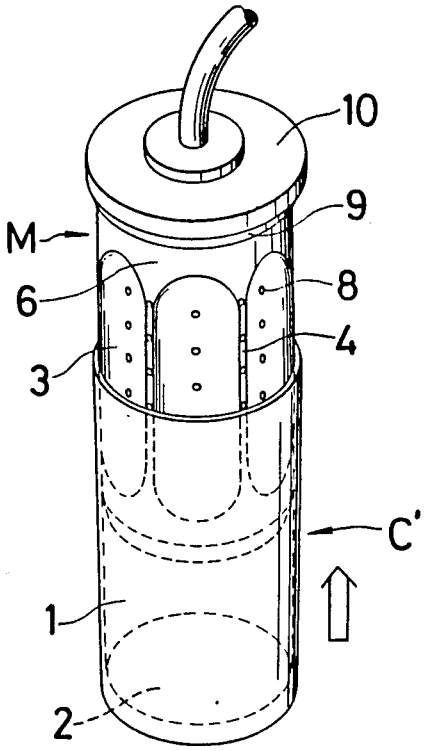
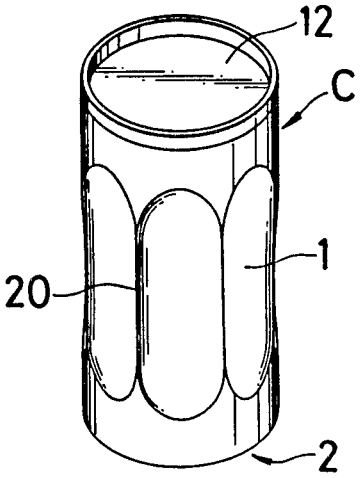
FIG.12

MANDREL FOR USE IN MANUFACTURING AN ANGLED AND CYLINDRICAL CONTAINER

This is a division of application Ser. No. 627,435, filed July 3, 1984, now U.S. Pat. No. 4,581,003.

FIELD OF THE INVENTION

The present invention relates to a method for manufacturing a paper container in which a body portion is formed into a polygonal shape in cross-section in order to prevent the body portion from being deformed into an irregular shape due to a pressure difference between the interior and exterior of the container produced when the contents are cooled after the container has been filled with juice or the like at a high temperature and sealed. A preliminary formed container, wherein a closing member is secured to one of upper and lower open ends of a cylindrical body member, is mounted on a mandrel, which is polygonal and has a cross-sectional shape in which the sides constituting a polygon are inwardly curved, and the body member is subjected to vacuum attraction through a hole provided in the mandrel and is depressed while adjusting to the cross-sectional shape of the mandrel to form a polygon.

DESCRIPTION OF THE PRIOR ART

In the past, in a paper container for filling with juice or the like at a high temperature, a method has been known in which creases of regular shape are provided on a body portion and portions surrounded by the creases are intentionally deformed to prevent depression and irregular deformation of a container caused by a negative pressure phenomenon resulting from cooling of filled contents after having been filled and sealed. However, even in the case of the container in which the body portion is formed with the creases, the body portion itself is formed of a relatively thick material in terms of strength and has a considerable rigidity, and therefore, the container is not always deformed (depressed) into a shape as initially set but it is awkardly deformed to impair quality and appearance.

In view of the foregoing, as means for solving the above-described problems, a method has been proposed in which not only creases are provided on the body portion but portions surrounded by the creases and to be deformed due to the negative pressure phenomenon are depressed beforehand to some extent prior to filling with contents to intentionally and regularly produce deformation due to the negative pressure phenomenon after the container has been filled.

To realize such a method as described above, the present inventor has already filed a U.S. Patent Application Ser. No. 388,689 filed on June 15, 1982.

In the manufacturing method of this application, the body portion is pressed from the outside on the mandrel and formed by a vertically movable jig. However, this application has problems in that since the process is complicated, the operating efficiency is low damage to the surface of the body portion such as by wrinkling sometimes occurs impairing the appearance, it is difficult to evenly press the whole body member, and it is difficult to sufficiently depress the body portion.

SUMMARY OF THE INVENTION

The present invention relates to a method for manufacturing a container in which closing members are provided on upper and lower open ends of an angled and cylindrical body portion. A closing member is secured to one open end of a cylindrically formed body member to form a preliminary formed container. The preliminarily formed container is mounted on a mandrel, which has a sectional shape of a curved surface obtained by inwardly depressing the sides of a suitable polygon and in which each surface thereof is provided with small holes in connection with an inner attractive hole. The body portion is subjected to vacuum attraction through the attractive hole and depressed while adjusting to the sectional shape of the mandrel. Compressed air is fed through the attractive hole to disengage the preliminarily formed container from the mandrel to form an angled and cylindrical container.

BRIEF DESCRIPTION OF THE DRAWINGS

FIG. 10 is a perspective view showing a first embodiment in which a preliminarily formed container is mounted on the mandrel;

FIG. 11 is a perspective view showing the second embodiment; and

FIG. 12 is a perspective view showing a container manufactured by the manufacturing method of the present invention.

DESCRIPTION OF THE PREFERRED EMBODIMENTS

Embodiments of the present invention will be described with reference to the drawings.

Figure 1:
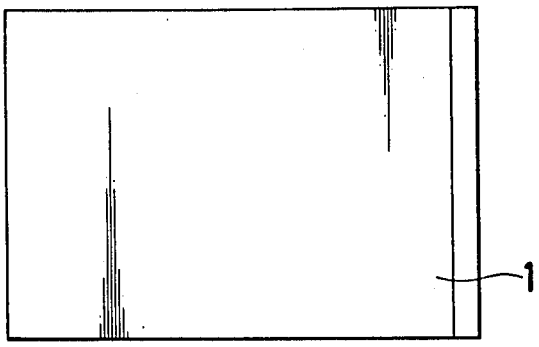
FIG. 1 is a developed view of a first embodiment of a body member of a container according to the present invention.
Figure 4:
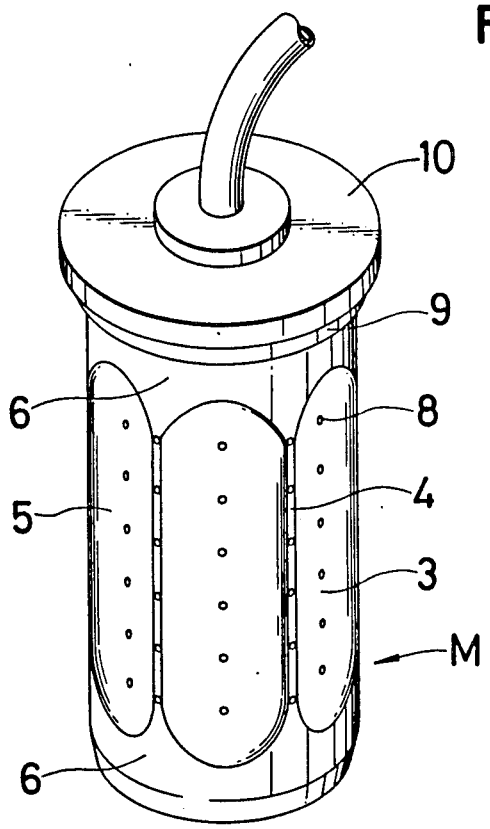
FIG. 4 is a perspective view of a mandrel used in connection with the present invention.
Figure 5:
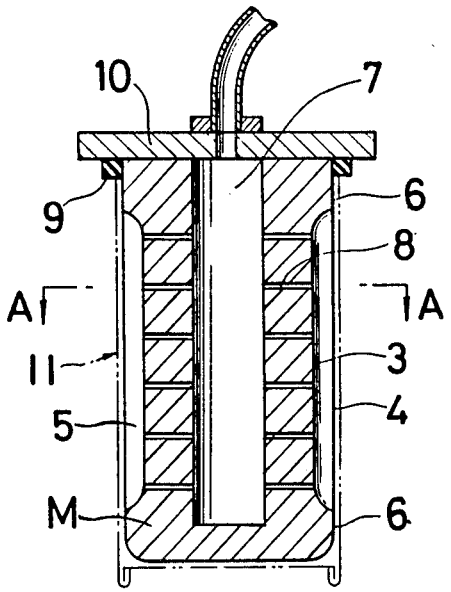
FIG. 5 is a side view of the side portion of the same.
Figure 6:
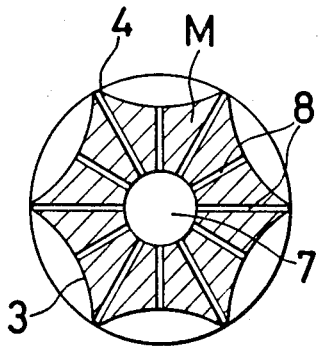
FIG. 6 is a sectional view taken on line A—A of FIG. 5.

A square-shaped body member 1, which is square as shown in FIG. 1, is formed of a laminated material composed of a combination of at least two materials such as paper, synthetic resin and metal foil. A mandrel which forms the body member 1 into a preliminarily formed container C′ (shown in FIG. 11) is formed into curved surfaces 3 by inwardly depressing sides of a suitable polygon as shown in FIGS. 4, 5 and 6, and projected portions 4 are formed on boundaries between the adjacent curved surfaces 3, 3 to provide a sectional shape like a starfish. Adjacent upper and lower portions of the projected portions 4 are continuously joined to each other in a circular fashion to provide body forming recess portions 5 having ends shaped to restrict said curved surfaces 3. Cylindrical portions 6, 6 equal in outside diameter to the projected portions 4 are provided on upper and lower portions of the recess portions 5. The suitable number of small holes 8, which are in connection with an atrractive hole 7 axially provided, are provided in the surface of the body-forming recess portions 5. One end of the side of the body member 1 is held by a holder (not shown) having a groove, which is provided within the projected portion 4 on the mandrel M with a keep member 10 through a packing 9 at the upper end thereof and which has the same construction as that normally used during molding of a cup. As shown in FIG. 10, the mandrel M is rotated and wound while bringing an upper end of the body member 1 into abutment with the lower end of the packing 9, and the mandrel M is rotated once so that the other side end of the body member 1 is superposed, in which state, they are adhered together by way of a supersonic seal or heat seal to form a cylindrical configuration. A disc-like closing member 2 separately prepared on an open end of the body member 1 is fixed by the same means as the method normally used for manufacturing a bottom of a paper cup so that it is formed into a preliminarily formed container C'.

Figure 7:
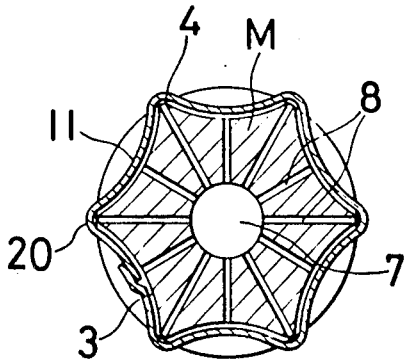
FIG. 7 is a sectional view taken on line A—A showing a body member of a container depressed.
Figure 8:
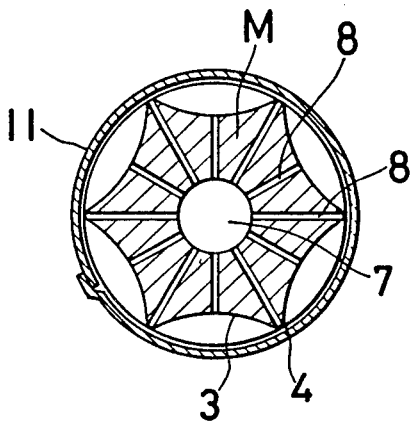
FIG. 8 is a sectional view taken on line A—A in which a preliminarily formed container which has used the body member of FIG. 1 is mounted on the mandrel.

Vacuum attraction is carried out through the small holes 8, by a vacuum attraction source (not shown) in connection with the attractive hole 7 through the hole provided in the center of the keep member 10 of the mandrel M, to depress the body member 1 along the curved surfaces 3 of the mandrel M. As a consequence, a portion of the body member 1 where it contacts the projected portion 4 of the mandrel M is an edge line 20 and similarly, a portion thereof where it contacts the curved surface 3 is to be inwardly depressed. Therefore, as shown by the oblique lines of FIG. 7, a prismatic (more than a triangle) body portion 11 whose each surface is inwardly depressed is formed which body portion coincides with a sectional shape of the mandrel M.

Next, a preliminarily formed container C' having the body portion 11 is disengaged from the mandrel M by feeding compressed air from the samll holes 8 through the attractive hole 7 conversely to the vacuum attraction.

Thereafter, juice or the like is filled at a high pressure and temperature of approximately 90° C. (194° F.) from an unlcosed open end, and a separately prepared closing member 12 is fixed to form a container C (shown in FIG. 12).

In a further embodiment of the present invention other than the above-described embodiment, in forming a preliminarily formed container C', both ends of the body member 1 are adhered beforehand as shown in FIG. 11 by a process separate from the manufacturing method of the present invention to provide a cylindrical configuration, and a closing member 2 is fixed to one open end and molded, after which it is mounted on the mandrel M so that the open end contacts the lower end of the packing 9 to form an angled and cylindrical body portion 11.

Figure 2:
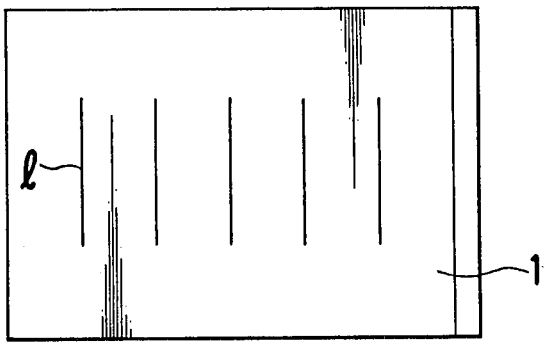
FIG. 2 is a developed view of a second embodiment of the same.
Figure 3:
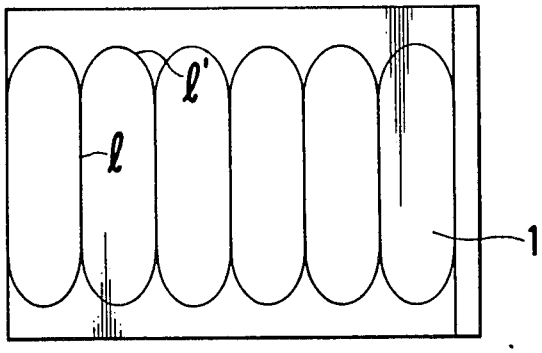
FIG. 3 is a developed view of a third embodiment of the same.
Figure 9:
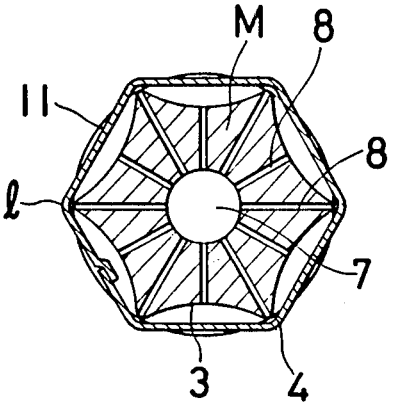
FIG. 9 is a sectional view taken on line A—A which likewise uses the body member of a container shown in FIG. 2.

As shown in FIG. 2, straight creases l are provided beforehand on the body member 1 at the intervals substantially equal in length to the distance between the projected portions 4 adjacent each other on the mandrel M, and more preferably, as shown in FIG. 3, creases l' by which adjacent upper and lower ends of the creases l are continuously joined in an arc-shaped fashion. Then, the body portion 11 will be an angled and cylindrical configuration when the preliminarily formed container is formed. Therefore, when it is mounted on the mandrel M for vacuum attraction, the distance between the deepest portion of the curved surface 3 of the mandrel M and the body member 1 is extremely short as compared with the preliminary formed container formed of a flat body member as in the above-described embodiment as shown in FIG. 9. In addition, a portion in the vicinity of the edge line 20 which is the most difficult to form a portion by which upper and lower ends of the edge line 20 are joined in a circular fashion have been formed as the creases l and l' to some extent, and therefore, it is possible to form a depression simply and clearly by the body portion 11.

If the small holes 8 for attraction and disengagement provided in the mandrel M are provided not only in the curved surfaces 3 but in the projected portions 4, a portion in the vicinity of the edge line 20 of the body portion 11 to which a greatest load is applied is brought powerfully into close contact with the projected portion 4 of the mandrel M to form a more definite edge line 20.

As described above, in the present invention, as opposed to a conventional method for pressing a body member on the mandrel by mechanical means from outside, the body member can be depressed by vacuum attraction inwardly of the mandrel without making any other jig or the like contact the body member. Therefore, the surface of the body member is not scratched nor wrinkled to accurately provide a polygonal configuration without impairing its external appearance. Moreover, since in the conventional pressing system, the body member is to be bent by movement of the jig, if attending to one point of the body member, the jig merely passes through once whereas in the system of the present invention, the vacuum attractive force is simultaneously applied to the whole body member, and therefore, non-smoothing time can be prolonged to accurately provide a polygonal configuration.

There are two methods for mounting a preliminarily formed container on a mandrel, one is to effect this after a preliminarily formed container is preformed, and the other is to effect his simultaneously while forming a preliminarily formed container on the mandrel. These methods are selectively employed.

Furthermore, if creases are provided beforehand on a body member of a preliminarily formed container, a body portion can be easily depressed by vaccum attraction into a polygonal configuration and a beautiful shape in conformity with the creases may be obtained.

What is claimed is:

1. A mandrel for use in manufacturing a container comprising a mandrel body having an outer surface substantially corresponding to the shape of a cylinder, a plurality of recessed portions located about the circumference of said mandrel body, said plurality of recessed portions forming said mandrel body into a shape having a cross-section substantially corresponding to a shape of a polygon whose sides are inwardly depressed from said substantially cylindrical outer surface to form curved surfaces, a plurality of connecting portions separating said plurality of recessed portions, said plurality of connecting portions being located substantially at said cylindrical outer surface of said mandrel, a central channel located within said mandrel, and a plurality of apertures located within said plurality of recessed portions and connecting said plurality of recessed portions with said central channel, whereby a vacuum can be applied through said plurality of apertures to conform a container body placed upon the outer surface of said mandrel to the shape of said mandrel.

2. The mandrell of claim 1 wherein said plurality of recessed portions are provided in an intermediate portion of said mandrel, and wherein said mandrel includes upper and lower portions surrounding said intermediate portion, said upper and lower portions having a substantially cylindrical configuration.

3. The mandrel of claim 1 wherein said plurality of apertures comprises a first plurality of apertures, and including a second plurality of apertures located at said plurality of connecting portions and connecting said plurality of connecting portions with said central channel, whereby a vacuum can be applied through said first and second plurality of apertures.

* * * * *